US009790137B1

(12) United States Patent
Stepanov et al.

(10) Patent No.: US 9,790,137 B1
(45) Date of Patent: Oct. 17, 2017

(54) NANOSCALE COCRYSTALLINE EXPLOSIVES

(71) Applicants: Victor Stepanov, Highland Park, NJ (US); Reddy Damavarapu, Hackettstown, NJ (US); Rajen Patel, Parsippany, NJ (US); Hongwei Qiu, Harrison, NJ (US)

(72) Inventors: Victor Stepanov, Highland Park, NJ (US); Reddy Damavarapu, Hackettstown, NJ (US); Rajen Patel, Parsippany, NJ (US); Hongwei Qiu, Harrison, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 184 days.

(21) Appl. No.: 14/733,208

(22) Filed: Jun. 8, 2015

Related U.S. Application Data

(63) Continuation-in-part of application No. 14/620,621, filed on Feb. 12, 2015.

(51) Int. Cl.

| | |
|---|---|
| ***C06B 45/22*** | (2006.01) |
| ***D03D 23/00*** | (2006.01) |
| ***D03D 43/00*** | (2006.01) |
| ***C06B 25/34*** | (2006.01) |
| ***C06B 21/00*** | (2006.01) |

(52) U.S. Cl.
CPC ..... *C06B 45/22* (2013.01); *C06B 21/0025* (2013.01); *C06B 25/34* (2013.01)

(58) Field of Classification Search
USPC ..... 149/11, 109.4, 109.6
See application file for complete search history.

(56) References Cited

U.S. PATENT DOCUMENTS

| | | | | |
|---|---|---|---|---|
| 8,936,689 | B1 * | 1/2015 | Stepanov | C06B 21/0008 149/109.6 |
| 2012/0305150 | A1 * | 12/2012 | Matzger | C06B 21/0066 149/92 |
| 2015/0080567 | A1 * | 3/2015 | Salan | C06B 25/34 540/475 |
| 2016/0177698 | A1 * | 6/2016 | Schultheiss | E21B 43/26 166/250.1 |

OTHER PUBLICATIONS

RDECOM powerpoint presentation on different explosive crystals, 2017.*

* cited by examiner

*Primary Examiner* — James McDonough
(74) *Attorney, Agent, or Firm* — Lisa H. Wang

(57) ABSTRACT

A method of manufacturing a CL-20/HMX cocrystalline explosive which is coated in a polymeric binder, so as to be useful as an explosive molding powder. The cocrystalline material having a desirable average crystal size of from about 300 nm to about 1000 nm, which crystals are intimately coated with a polymeric binder and are produced as granular agglomerates that are less than on average 5 microns in size, and which crystals are relatively easy and safe to handle, transport, store and use. The method involving spray drying a CL-20 and HMX solvent solution containing a polymeric binder to form an intermediary amorphous material—which intermediary is then heated to cocrystallize the CL-20/HMX into the desired size cocrystals and aggregates thereof—which are coated in said polymeric binder.

7 Claims, 2 Drawing Sheets

NANOSCALE COCRYSTALLINE EXPLOSIVES

CROSS REFERENCE TO RELATED APPLICATIONS

This application is a continuation-in-part of currently co-pending U.S. patent application Ser. No. 14/620,621, filed Feb. 12, 2015, which co-pending application is hereby incorporated by reference, as if set-out herein in its entirety.

FEDERAL RESEARCH STATEMENT

The inventions described herein may be manufactured, used, and licensed by, or for the U.S. Government, for U.S. Government purposes.

BACKGROUND OF INVENTION

Field of the Invention

The present invention relates to an effective and efficient spray drying process for the production of CL-20/HMX cocrystals which results in a desirable nanoscale size range.

Related Art

Cocrystals are unique crystalline structures which consist of at least two different component materials ("co-formers") in a fixed ratio. While the individual components typically exist as discrete crystalline materials, under suitable conditions compatible crystalline materials may crystallize into a new cocrystalline material, in which the hybrid cocrystalline material contains the coformers in a fixed ratio. Such cocrystalline materials are currently sought after as a means to engineer materials with new properties. Relatively recently, a significant number of new cocrystals have been reported, particularly in the pharmaceutical industry (see, N. Qiao et al., "Pharmaceutical cocrystals: An overview," International Journal of Pharmaceutics 419 (2011) 1-11).

2,4,6,8,10,12-Hexanitro-2,4,6,8,10,12-hexaazaisowurtzitane (CL-20 or HNIW), is a high density energetic developed by the U.S. military. This high explosive compound has a high detonation velocity and pressure (and thus is a strong explosive). An important drawback of CL-20 is its relatively high shock sensitivity, making it unsuitable for some applications and U.S. Military specifications.

In U.S. published patent application 2012/0305150, to Matzger et al., various pure cocrystalline explosive materials are disclosed, including one containing both CL-20 and octahydro-1,3,5,7-tetranitro-1,3,5,7-tetrazocine (HMX) in a 2:1 molar ratio. And, it is further disclosed that this hybrid explosive cocrystalline material can be effectively used as an energetic filler or propellant component in weapons systems to provide increased anti-armor penetration, enhanced missile payload velocity and flight, increased underwater torpedo effectiveness and lethality, improved gun propellant impetus, and mining and blast applications. In fact, it is disclosed that the CL-20/HMX cocrystalline material has the advantage that it is less impact sensitive, when compared to CL-20, and is a more powerful explosive (i.e., higher detonation velocity etc.) than HMX.

The method of manufacture of the CL-20/HMX cocrystalline material disclosed in the U.S. published patent application 2012/0305150 is evaporative crystallization. More specifically, this evaporative crystallization process disclosed in the 2012/0305150 application involves the cocrystal being formed by evaporating a solution of CL-20 and HMX in any of a number of alternative organic solvents. CL-20 and HMX may be combined in a ratio that promotes the formation of a cocrystal by evaporation. The solution can be sonicated for a short time to aid in dissolution of the CL-20 and the HMX. After sonication, the solution can be decanted and the solids recovered by conventional known means, such as centrifugation; washing, i.e. purifying; dehydration; filtration; or a combination thereof. In various embodiments, a dehydrating agent is added to the slurry to aid in the recovery of the cocrystals. The dehydrating agents include 3A, 4A and 5A molecular sieves. However, it is known that the crystals provided by such evaporative crystallization are substantially pure and relatively large, on the order of about 10 to about 100 microns or greater—and that the resulting explosive materials will not provide the desired lower sensitivity of smaller crystals/particles. See Stepanov et al., "Production and Sensitivity Evaluation of Nanocrystalline RDX-based Explosive Compositions," Propellants Expos. Pyrotech., 36, 240-246, 2011.

An alternative means of producing CL-20/HMX cocrystals in a nano-sized form, with an average particle/crystal size of 250 nanometers, within a size distribution of from 50 to 400 nanometers, is disclosed in an article by Bing Gao, et al, entitled: Facile, continuous and large-scale synthesis of CL-20/HMX nano co-crystals with high performance spray-assisted electrostatic absorption method. See, Journal of Materials Chemistry A, 2014, Vol. 2, pp. 19969-19974. This article discloses a process wherein the raw CL-20 and HMX are dissolved in acetone at a concentration below the saturation point (to obtain a complete solution). This solution is subjected to ultrasonic atomization, producing fine droplets that are transported by an inert gas to an oven or precipitator, wherein the solvent evaporates and the nano-sized crystals are formed. The fine, particulate product is collected electrostatically. This process, as stated above, results in a product consisting of pure cocrystal particles with an average size of 250 nanometers—and a size distribution of from 50 to 400 nanometers—such that a significant portion of the particles will be from 50 to 250 nanometers. Significant drawbacks of this method include safety issues with such pure, very small particles and difficulties in handling such pure, very small nanoparticles—which present significant challenges in preparation of useful explosive formulations, due in part to difficulties with dispersion and coating of such particles.

Another alternative means of producing the desired CL-20/HMX 2:1 molar ratio explosive cocrystalline material is disclosed in an article by D. Spitzer, et al., entitled: Continuous engineering of nano-cocrystals for medical and energetic applications. See, Science Reports, Vol. 4, p 6575, DOI:10.1038/srep06575. The method of production disclosed by this article involves dissolving the coformer CL-20 and HMX crystals in a low boiling point solvent; using an overpressure of 40 to 60 bars to atomize the solvent into an evacuated atomization chamber by means of a heated hollow cone nozzle. The pressure in the atomization chamber is kept constant at 5 mbar—such that when the atomized solvent is injected there is ultrafast evaporation thereof, which induces crystallization of the solute. The reported resulting cocrystal mean particle size of pure CL-20/HMX 2:1, was 59 nm—and, the subject method reportedly prevents any further growth. Therefore, the pure CL-20/HMX cocrystals obtainable from this method suffer from the same handing and processing difficulties and safety issues as those obtainable from the method disclosed in the article by Bing Gao et al., discussed above.

Considering the above disclosed processes for forming relatively pure CL-20/HMX cocrystals of relatively large and very small crystals, there is a need for method to produce CL-20/HMX cocrystals which do not suffer from the same handling and safety characteristics.

SUMMARY OF INVENTION

The present invention addresses the above detailed handling and safety problems of the pure CL-20/HMX cocrystals available from the known prior art production methods, by providing a new and novel, effective and efficient method of production for such explosive cocrystals coated with a polymeric binder and of a desirable size. The subject inventive method involves the rapid evaporative precipitation of the CL-20 and HMX coformers from an organic solvent solution using conventional spray drying, to obtain a highly amorphous intermediate material containing a polymeric binder, which is then subject to heat; whereby, surprisingly the desired CL-20/HMX cocrystals coated with the polymeric binder form in a relatively rapid manner, and with a desirable size range—thereby providing safer and more effective handling and storage. The inventive method involves the steps of (1) fully dissolving a 2:1 molar ratio of CL-20 and HMX in a low boiling point/high vapor pressure solvent, such as acetone; (2) adding and dissolving a quantity of from about 5 to about 30 weight percent of a polymeric binder, preferably PVAc (polyvinyl acetate) or a short chain polymeric binder, such as VMCC; (3) spray drying the solution containing the coformers and polymer to obtain a relatively dry amorphous powder material; and then (4) subjecting the dried amorphous material containing the CL-20, HMX, and polymeric binder to a raised temperature environment, such as about 100 degrees C. for a period of about 5 hours, where, even with the presence of the polymeric binder, the desired crystalline CL-20/HMX crystalline material/powder forms—which cocrystals are coated by the polymeric binder. Importantly, the resulting CL-20/HMX 2:1 molar cocrystalline material has a desirable mean crystal size of from about 300 nm to about 1000 nm, which crystals agglomerate into granules that are less than, on average, about 5 microns in size.

As stated above, the subject inventive CL-20/HMX cocrystalline material contain from about 5% to about 30% by weight of a polymeric binder—in order to form the requisite amorphous precursor material, which is a necessary prerequisite to the subsequent cocrystallization and which provides a final CL-20/HMX cocrystalline material that is coated in such binder for improved handling and safety. With the coating of such a polymeric binder—after the formation of the desired cocrystalline material—this cocrystalline material can be relatively easily handled, pressed into a cylindrical pellet or other configuration as desired, i.e. an explosive/propellant molding powder, and will exhibit improved safety characteristics including reduced sensitivity to stimuli, such as, friction, electrostatic discharge, and impact.

Further features and advantages of the present invention will be set forth in, or apparent from, the drawings and detailed description of preferred embodiments which follows.

BRIEF DESCRIPTION OF THE DRAWINGS

A more complete understanding of the present invention disclosure may be realized by reference to the accompanying drawings in which.

DETAILED DESCRIPTION

As detailed above, the present invention provides a method of production for a new cocrystalline Cl-20:HMX with a 2:1 molar ratio material, which is readily useful in current military munitions, as a replacement for such munitions' main charge, boosters, and detonator output charges, and the like. Further, as also stated above, the subject cocrystalline explosive material offers significant handling and safety benefits over similar cocrystalline materials manufactured by prior art methods—such methods not capable of providing the present invention's polymeric coated cocrystals, which cocrystals have a mean crystal size of from about 300 nm to about 1000 nm, which crystals agglomerate into granules that are less than, on average, about 5 microns in size, i.e. desirable, as being relatively easily handled/transported/stored and exhibiting needed safety characteristics.

Figure 1:
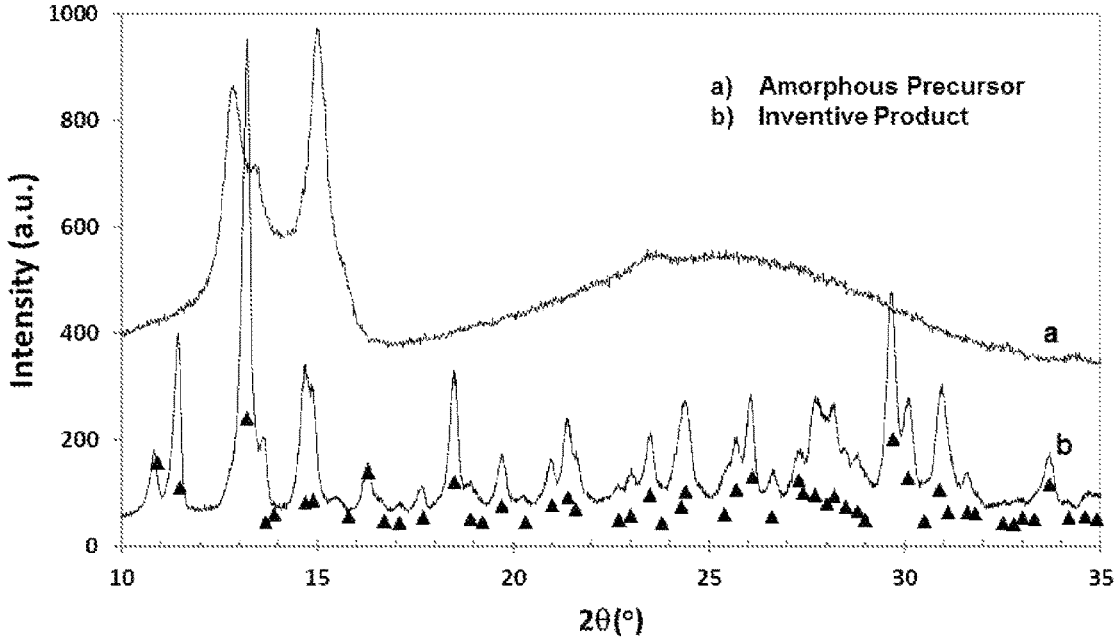
FIG. 1 shows the Powder X-ray Diffraction (PXRD) patterns for 1) the amorphous CL-20/HMX/PVAc amorphous precursor prepared by spray drying marked as (a), 2) the product material of the subject invention consisting of CL-20:HMX (2:1) cocrystalline powder containing 10 wt % PVAc marked as (b), and c) triangular reference markers for PXRD peaks of the CL-20:HMX (2:1) cocrystal. See, Bolton et al., Cryst. Growth Des. 2012, 12, 4311-4314.

The new CL-20/HMX (2:1) material of the present invention was collected and analyzed by Powder X-ray Diffraction (PXRD). And, referring to FIG. 1, the intermediate material of the present invention shown in the upper pattern (a)—with no distinct peaks is thereby proven to be amorphous. And, further, this intermediate material after further heating, per the present invention, subsequently converts to the desired crystalline form—as proven by the distinct peaks shown in the middle pattern (b) thereof which matches the published reference pattern of the CL-20:HMX (2:1) cocrystalline material as disclosed by Bolton et al, Cryst. Growth Des. 2012, 12, 4311-4314.

Figure 2:
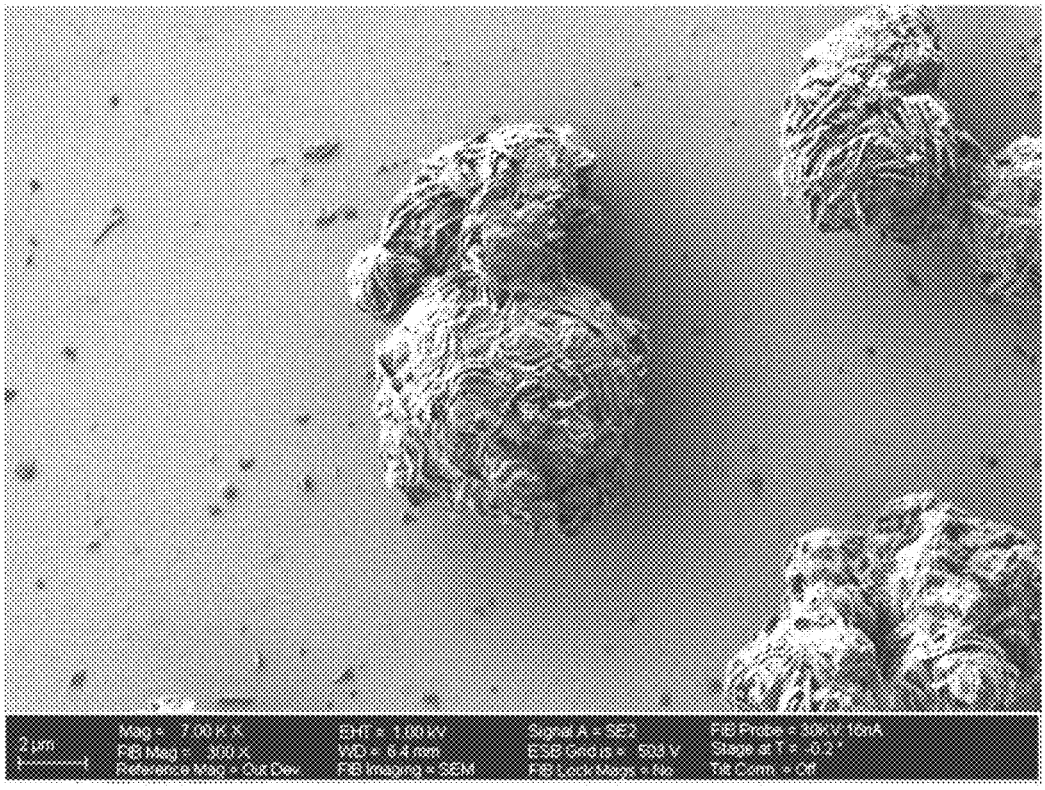
FIG. 2 is a Scanning Electron Microscopy (SEM) image of the granular agglomerates of the CL-20:HMX (2:1) cocrystalline powder of the subject invention containing 10 wt % PVAc.

Further, the final CL-20/HMX (2:1) cocrystalline powder product of the present invention was analyzed by Scanning Electron Microscope as seen in FIG. 2. In this figure, the product appears in a granular form of plate-like crystals—with a mean crystal size below 1 micron and with the mean size of the granules below 5 microns.

Preferably, any form of CL-20 and HMX can be used in the present invention—the CL-20 being available from Alliant Techsystems Inc. (aka ATK), located in Arlington, Va., and the HMX from BAE Systems, Inc., Arlington, Va. Alternative binders useful in the present invention include vinyl resins, acrylic resins, cellulose resins, phenolic resins, epoxy resins—wherein a particularly preferred binder is PVAc, which is available from Sigma-Aldrich, St. Louis, Mo., as is the preferred acetone solvent. The particularly preferred PVAc binder has a molecular weight of from about 10,000 to about 1,000,000, preferably about 100,000. An alternatively preferred binder is VMCC, which is a resin binder composed of a carboxy-functional terpolymer consisting of vinyl chloride (83%), vinyl acetate (18%), and maleic acid (1%). The VMCC resin binder has a 19,000 MW and a 1.34 g/cc density.

To aid in the understanding of the subject invention, the following example of the inventive process is provided as illustrative thereof; however, it is merely an example thereof and should not be construed as limitations on the claims:

Example

A solution was prepared by dissolving 5.4 g of CL-20, 1.8 g of HMX, and 0.8 g of polyvinyl acetate (PVAc) 100,000

M.W. in 100 g of acetone at ~20° C. Next the solution was spray dried using a Buchi model B-290 laboratory spray dryer, available from Buchi Labortechnik AG, Melerseggstrasse-40, Postfach, 9230 Flawil, Switzerland, which spray dryer was equipped with a two-fluid gas nozzle (0.7 mm diameter), i.e. a typical commercially available lab scale spray dryer. $N_2$ was used for atomization as well as the drying gas—though any inert gas will suffice. The spray drying gas inlet temperature was set to 90° C. The spray drying gas flow rate was set to ~35 $m^3$/hour. The liquid feed rate was set to 5 ml/min. The intermediate amorphous product was collected using a cyclone separator and then placed in an oven to provide a hot environment, about 100° C. for a period of about 5 hours—to obtain the desired cocrystalline product coated in the polymeric binder. The intermediate amorphous spray dried material and the final CL-20/HMX cocrystalline product were, as stated above, assessed using PXRD to show the amorphous nature of the intermediate product and the cocrystalline nature of the final inventive product. Further, as detailed above, the final polymer coated product was analyzed by SEM to establish the agglomerated cocrystals into granules of below 5 microns, composed of CL-20/HMX (2:1) with a mean crystal size in the about 300 to about 1000 nm range.

Although the invention has been described in-part above in relation to embodiments thereof, it will be understood by those skilled in the art that variations and modifications can be effected in these preferred embodiments without departing from the scope and spirit of the invention as claimed below.

What is claimed is:

1. A method of manufacturing a CL-20/HMX cocrystalline powder material comprising:

(a) dissolving a 2:1 molar ratio of CL-20 and HMX in a low boiling point solvent to form a solution;

(b) adding to and dissolving within said solution a quantity of about 5 to about 30 weight percent of a polymeric binder;

(c) spray drying the solution containing the dissolved polymeric binder to obtain an amorphous intermediary material;

(d) after spray drying, heating said amorphous intermediary for an effective period of time to obtain the CL-20/HMX cocrystals which are coated in said polymeric binder;

(e) wherein the mean crystal size of the CL-20/HMX cocrystals are from about 300 nm to about 1000 nm, and wherein said cocrystals are in a granular agglomerate form having a mean granule size of below 5 microns.

2. The method of claim 1, wherein said low boiling point solvent is acetone.

3. The method of claim 1, wherein said polymeric binder is selected from the group consisting of PVAc and VMCC.

4. The method of claim 1, wherein said amorphous intermediate is oven heated at a temperature of 100° C.

5. The method of claim 1, wherein said cocrystalline CL-20/HMX powder is used as an explosive molding powder and pressed into a desired configuration.

6. The method of claim 1, wherein the said effective period of time to obtain the CL-20/HMX cocrystals is about 5 hours.

7. The method of claim 1, wherein the quantity of polymeric binder is 10 weight percent.

* * * * *